US009936751B1

(12) United States Patent
Mignone

(10) Patent No.: US 9,936,751 B1
(45) Date of Patent: Apr. 10, 2018

(54) TOWEL/ABSORPTIVE ARM SLEEVE AND MEANS OF HANDS FREE TOWELING

(71) Applicant: Francesco Mignone, Tuckahoe, NY (US)

(72) Inventor: Francesco Mignone, Tuckahoe, NY (US)

( * ) Notice: Subject to any disclaimer, the term of this patent is extended or adjusted under 35 U.S.C. 154(b) by 861 days.

(21) Appl. No.: 14/211,139

(22) Filed: Mar. 14, 2014

Related U.S. Application Data

(60) Provisional application No. 61/783,460, filed on Mar. 14, 2013.

(51) Int. Cl.
*A41D 31/00* (2006.01)

(52) U.S. Cl.
CPC ..... *A41D 31/0011* (2013.01)

(58) Field of Classification Search
CPC ..... A41D 13/0015; A41D 1/06; A41D 27/08; A41D 1/04; A41D 15/00; A41D 13/0012; A41D 1/00; A41D 27/20; A41D 15/04; A41D 1/002; A41D 2400/38; A41D 1/02; A41D 3/00; A41D 3/08; A41D 13/002; A41D 13/005; A41D 27/28; A41D 13/02; A41D 13/065; A41D 27/10; A41D 13/015; A41D 13/1245; A41D 1/08; A41D 2300/22; A41D 2200/20; A41D 27/205; A41D 13/0518; A41D 13/129
USPC ..... 2/69, 59, 22, 242, 459
See application file for complete search history.

(56) References Cited

U.S. PATENT DOCUMENTS

| | | | | |
|---|---|---|---|---|
| 4,356,570 | A | 11/1982 | Vernon et al. | |
| 4,646,366 | A | 3/1987 | Nishida et al. | |
| 5,010,597 | A * | 4/1991 | Glover | A41D 17/02 2/22 |
| 5,014,360 | A | 5/1991 | Smith et al. | |
| 5,033,118 | A | 7/1991 | Lincoln | |
| 5,063,919 | A * | 11/1991 | Silverberg | A61F 15/004 2/16 |
| 5,090,060 | A | 2/1992 | Gates | |
| 5,143,762 | A * | 9/1992 | Ho | A41D 13/08 128/846 |
| 5,398,343 | A | 3/1995 | Kuracina | |
| 5,414,867 | A | 5/1995 | Bowling et al. | |
| 5,555,564 | A | 9/1996 | Welch | |
| 5,582,583 | A | 12/1996 | Ballantyne | |
| 5,614,302 | A | 3/1997 | Nance, Jr. | |
| 5,638,546 | A * | 6/1997 | Vita | A41D 13/08 2/16 |
| 5,658,324 | A | 8/1997 | Bailey, Sr. et al. | |
| 5,740,556 | A | 4/1998 | Brown | |
| 5,787,503 | A | 8/1998 | Murphy, III | |
| 5,836,904 | A | 11/1998 | Cooper | |

(Continued)

*Primary Examiner* — Clinton T Ostrup
*Assistant Examiner* — Catherine M Ferreira
(74) *Attorney, Agent, or Firm* — Steven M. Hoffberg; Tully Rinckey PLLC

(57) ABSTRACT

A sleeve having an absorptive surface, comprising a tubular structure having an exterior moisture absorptive surface, configured to fit around a wearer's arm, from shoulder to at least forearm, having an adjustable diameter to selectively control a snugness of the tubular structure on the upper arm area and the lower arm area, while permitting free flexion of the elbow, having at least three elastic bands having a non-slip surface against a wearer's skin to prevent movement of the tubular structure.

16 Claims, 18 Drawing Sheets

(56) References Cited

U.S. PATENT DOCUMENTS 5,867,826 A 2/1999 Wilkinson
5,887,279 A 3/1999 Elting et al.
5,924,130 A * 7/1999 Fragomeli ..... A41D 13/08 2/16
5,974,586 A * 11/1999 Reinoso ..... A41D 13/08 2/125
6,006,362 A 12/1999 Walsh
6,018,819 A 2/2000 King et al.
6,047,403 A * 4/2000 Juozaitis ..... A61F 15/004 2/239
6,049,908 A 4/2000 Bullock et al.
6,092,235 A * 7/2000 Santa Cruz ..... A41D 13/08 2/125
6,107,538 A 8/2000 Young et al.
6,148,445 A 11/2000 Spruill
6,210,352 B1 * 4/2001 Williams ..... A61F 15/004 128/849
6,243,867 B1 6/2001 Faison
6,272,888 B1 8/2001 Fujita et al.
6,332,221 B1 12/2001 Gracey
6,372,953 B1 4/2002 Young et al.
6,403,216 B1 6/2002 Doi et al.
6,426,445 B1 7/2002 Young et al.
6,530,090 B1 * 3/2003 Ambrose ..... A41D 13/1209 2/125
6,570,057 B1 5/2003 Schmidt et al.
6,590,136 B1 7/2003 Young et al.
6,591,425 B1 7/2003 Zellers
6,664,439 B1 12/2003 Arndt et al.
6,708,529 B2 3/2004 Yamazaki et al.
6,803,034 B2 10/2004 DuVal et al.
6,840,955 B2 1/2005 Ein
6,892,396 B2 5/2005 Uno et al.
7,017,577 B2 3/2006 Matich
7,047,572 B2 5/2006 Hopkins
7,096,510 B2 8/2006 Yeadon
7,100,213 B2 9/2006 Krautbauer
7,162,746 B2 1/2007 Reynolds
7,297,128 B2 11/2007 Binder et al.
7,354,425 B2 4/2008 Mizutani et al.
7,437,774 B2 10/2008 Baron et al.
7,437,775 B2 10/2008 Reynolds
7,534,236 B2 5/2009 Mizutani et al.
7,559,907 B2 7/2009 Krempel et al.
7,560,399 B2 7/2009 Rock et al.
7,681,253 B2 3/2010 Kobayashi
7,682,994 B2 3/2010 Van Emden et al.
7,685,650 B2 3/2010 Cotten
7,752,681 B2 7/2010 Michel
7,803,438 B2 9/2010 Flather et al.
7,842,628 B2 11/2010 Yasui et al.
7,857,777 B2 12/2010 Larson et al.
7,930,767 B2 4/2011 Reynolds
7,954,170 B2 6/2011 Hofer et al.
7,959,758 B2 6/2011 Flather et al.
7,971,271 B2 7/2011 Raghuprasad
8,011,018 B2 9/2011 Trespalacios
8,016,778 B2 9/2011 Brown et al.
8,016,779 B2 9/2011 Brown et al.
8,021,388 B2 9/2011 Brown et al.
8,024,023 B2 9/2011 Tolvanen
8,029,450 B2 10/2011 Brown et al.
8,034,007 B2 10/2011 Avitable et al.
8,070,699 B2 12/2011 Avitable et al.
8,109,892 B2 2/2012 Brown et al.
8,128,584 B2 3/2012 Brown
8,150,525 B2 4/2012 Fassih et al.
8,162,861 B2 4/2012 Avitable et al.
8,172,459 B2 5/2012 Abreu
8,297,285 B2 10/2012 Henry et al.
8,328,420 B2 12/2012 Abreu
8,328,781 B2 12/2012 Mizutani et al.
8,353,886 B2 1/2013 Bester, Jr. et al.
8,367,168 B2 2/2013 Flather et al.
8,506,508 B2 8/2013 Avitable et al.
8,517,963 B2 8/2013 Larson et al.
8,555,414 B2 10/2013 Davis et al.
8,590,063 B2 11/2013 Aulenbach
8,597,215 B2 12/2013 Avitable et al.
8,622,942 B2 1/2014 Avitable et al.
8,674,810 B2 3/2014 Uysal et al.
8,695,115 B2 4/2014 Leyva
8,704,758 B1 4/2014 Figley et al.
8,715,329 B2 5/2014 Robinson et al.
8,721,575 B2 5/2014 Brown
8,740,828 B2 6/2014 Brown et al.
8,870,624 B2 10/2014 Hopkins
8,925,114 B2 1/2015 Jackson et al.
8,945,328 B2 2/2015 Longinotti-Buitoni et al.
8,948,839 B1 2/2015 Longinotti-Buitoni et al.
8,992,449 B2 3/2015 Avitable et al.
9,072,896 B2 7/2015 Dar et al.
9,072,898 B2 7/2015 Coleman et al.
9,084,713 B2 7/2015 Brown et al.
9,107,793 B2 8/2015 Avitable et al.
9,114,052 B2 8/2015 Avitable et al.
2001/0047531 A1 12/2001 Spies
2002/0007509 A1 1/2002 Kamada
2002/0026226 A1 2/2002 Ein
2002/0115581 A1 8/2002 DuVal et al.
2003/0056553 A1 3/2003 Yamazaki et al.
2003/0061650 A1 4/2003 Emanuel
2003/0106130 A1 6/2003 Reynolds
2003/0114818 A1 6/2003 Benecke et al.
2003/0115660 A1 6/2003 Hopkins
2003/0135174 A1 7/2003 Benecke et al.
2003/0167550 A1 9/2003 Andrews
2004/0016041 A1 1/2004 Uno et al.
2004/0048540 A1 3/2004 Dailly
2004/0083529 A1 5/2004 Tate
2004/0187188 A1 9/2004 Spies
2004/0258903 A1 12/2004 Eberle
2004/0260224 A1 12/2004 Binder et al.
2005/0050616 A1 3/2005 Krautbauer
2005/0059945 A1 3/2005 Schulson
2005/0075028 A1 4/2005 Rock et al.
2005/0125870 A1 6/2005 Spies
2005/0187071 A1 8/2005 Yamashita et al.
2005/0187502 A1 8/2005 Krempel et al.
2005/0273903 A1 12/2005 Rudman
2006/0085885 A1 4/2006 Williams
2006/0085886 A1 4/2006 Williams
2006/0124477 A1 6/2006 Cornelius et al.
2006/0172640 A1 8/2006 Leake
2006/0223400 A1 10/2006 Yasui et al.
2006/0264137 A1 11/2006 Ishihara et al.
2006/0276089 A1 12/2006 Amarasinghe et al.
2007/0032771 A1 2/2007 Abed et al.
2007/0113315 A1 5/2007 Reynolds
2007/0142794 A1 6/2007 Bester et al.
2007/0157354 A1 7/2007 Lee
2007/0271939 A1 11/2007 Ichigaya
2008/0052802 A1 3/2008 Bryan
2008/0096001 A1 4/2008 Emden et al.
2008/0132133 A1 6/2008 Yasui et al.
2008/0245361 A1 10/2008 Brown
2008/0249440 A1 10/2008 Avitable et al.
2008/0249441 A1 10/2008 Avitable et al.
2008/0249442 A1 10/2008 Brown et al.
2008/0249443 A1 10/2008 Avitable et al.
2008/0249444 A1 10/2008 Avitable et al.
2008/0249447 A1 10/2008 Brown et al.
2008/0249449 A1 10/2008 Brown et al.
2008/0249455 A1 10/2008 Brown et al.
2008/0249559 A1 10/2008 Brown et al.
2009/0044319 A1 2/2009 Lamson et al.
2009/0094727 A1 4/2009 Reynolds
2009/0144878 A1 6/2009 Mina
2009/0158491 A1 6/2009 Maier
2009/0177222 A1 7/2009 Brown et al.
2009/0260126 A1 10/2009 Rock et al.
2009/0320177 A1 12/2009 Lin et al.
2010/0005560 A1 1/2010 Albizre

(56) References Cited

U.S. PATENT DOCUMENTS

2010/0057147 A1 3/2010 Fassih et al.
2010/0178821 A1* 7/2010 Morris ..... A47K 10/02 442/1
2010/0180357 A1 7/2010 Hofer et al.
2010/0263102 A1 10/2010 Trespalacios
2011/0022137 A1 1/2011 Ennis-Thomas et al.
2011/0066091 A1 3/2011 Larson et al.
2011/0074380 A1 3/2011 Jeon
2011/0117353 A1 5/2011 Henshaw et al.
2011/0157863 A1 6/2011 Grimshaw
2011/0162130 A1 7/2011 Courvoisier
2011/0179544 A1 7/2011 Courvoisier
2011/0190677 A1 8/2011 Stelter et al.
2011/0197331 A1 8/2011 Reynolds
2011/0247127 A1 10/2011 Pou et al.
2011/0281500 A1 11/2011 Dunham
2011/0288504 A1 11/2011 Migliassi
2011/0301517 A1 12/2011 Brown et al.
2011/0306908 A1 12/2011 Brown et al.
2011/0306909 A1 12/2011 Brown et al.
2012/0004583 A1 1/2012 Avitable et al.
2012/0040154 A1 2/2012 Dinescu et al.
2012/0118497 A1 5/2012 Avitable et al.
2012/0209158 A1 8/2012 Avitable et al.
2012/0238923 A1 9/2012 Yamashita et al.
2012/0255098 A1 10/2012 Leyva
2013/0023808 A1 1/2013 Brown et al.
2013/0042380 A1 2/2013 Goodman
2013/0102461 A1 4/2013 Akiyama et al.
2013/0130591 A1 5/2013 Hopkins
2013/0131563 A1 5/2013 Ettner et al.
2013/0198920 A1 8/2013 Wittman
2013/0232654 A1 9/2013 Camillo
2013/0291268 A1 11/2013 Whaley
2013/0303049 A1 11/2013 Jackson et al.
2013/0324895 A1 12/2013 Avitable et al.
2013/0345610 A1 12/2013 Larson et al.
2014/0013485 A1 1/2014 Parker et al.
2014/0038149 A1 2/2014 De La Cruz
2014/0069624 A1 3/2014 Blackwell et al.
2014/0070957 A1 3/2014 Longinotti-Buitoni et al.
2014/0101825 A1 4/2014 Vedula et al.
2014/0109285 A1 4/2014 Amarasiriwardena et al.
2014/0110445 A1 4/2014 Eisner
2014/0135669 A1 5/2014 Avitable et al.
2014/0163482 A1 6/2014 Leyva
2014/0189933 A1 7/2014 Toronto
2014/0216640 A1 8/2014 Avitable et al.
2014/0315034 A1 10/2014 Akiyama et al.
2014/0345030 A1 11/2014 Liu
2015/0013039 A1 1/2015 Parker et al.
2015/0359687 A1 12/2015 Goda et al.

* cited by examiner

TOWEL/ABSORPTIVE ARM SLEEVE AND MEANS OF HANDS FREE TOWELING

CROSS REFERENCE TO RELATED APPLICATION

The present application is a non-provisional of, and claims priority under 35 U.S.C. §119(e) from, U.S. Provisional Patent Application No. 61/783,460, filed Mar. 14, 2013, the entirety of which is expressly incorporated herein by reference.

FIELD OF INVENTION

The present invention relates to the field of clothing, and more particularly to functional athletic clothing.

BACKGROUND OF INVENTION

It's commonly known that towels are used to wipe away and absorb sweat, bodily fluids, and water while working out, running, and performing other strenuous activities. The towel/absorptive material is effective in absorbing these bodily fluids for multiple reasons. These reasons for removing sweat can range from comfort to the person sweating to functionally removing sweat for grip or for visibility purposes.

Towels are used for all different sports, gym activities, and running/cross fit work outs. Some sports that use towels are basketball, football, baseball, soccer and on and on. The majority of these sports and many more would benefit the use of a towel to be available at all times and not only available during certain breaks or time outs during the course of play. In some sports like football, quarterbacks, running backs, wide receivers, and certain specialty lineman wear towels during the active course of the game. This serves as a disadvantage because these towels are usually worn hanging from the waistline from a belt or tucked into the pants. This can be slightly cumbersome, restricting, and plain annoying and interfering with sports play. In this instance the use of a hands free towel would be a major benefit and advantage to the game. In basketball you find this same problem. Players need the towel during play but have to wait until breaks and time outs to "towel off". This poses a problem for grip on the ball and visibility along as poses a hazard to the players as when their sweat flops onto the court it creates a slippery and dangerous condition.

Towels are also used during work outs in all different settings such as in the gym, outdoors, and indoors at home. Many times working out in a gym setting a towel is used in addition to wiping sweat to lay on workout equipment such as benches and stools to keep the users sweat from getting on the equipment and to also keep the user from contacting the equipment which may be dirty from a previous persons use along with just laying the towel some place while performing work out moves and activities. This poses a problem because the towel is now tainted and dirt from the equipment and in turn transfers the dirt and germs to the towels' user. Seeing how the towel is primarily used to wipe the users face, this poses a significant threat of getting germs and dirt directly into key germ spreading areas such as the mouth, eyes, nose, and ears, along with directly into the overly open pores of the skin due to perspiration and heat release.

Another common problem with gym work outs and towel use is the unavoidable touching of work out equipment and handle grips such as dumb bells, bar bells, pulley grips, machine grips (weights and cardio, e.g., elliptical machine, treadmills, stationary bikes, and climbers), etc., with the user's hands and then touching the towel with the dirty sweaty hands that were just in contact with the dirty work out equipment/grips. The towel is now tainted and dirty from the users' hands. Again the towel now transfers the dirt and germs from the equipment to the user's face and body being "toweled off". The use of work out gloves may prevent the users' hands from getting directly dirty or infected by pathogens that cause warts and other skin contact diseases, but do not prevent those same germs and dirt from being transferred from the surface of the gloves to the towel just as they would from the hand.

Lastly there are some situations where a towel is just not accessible, feasible, or just plain inconvenient to use while working out. Running outdoors poses an inaccessible setting as many people do not carry a towel with themselves while running. Even if a backpack is used the runner would have to inconveniently stop to open the backpack take the towel out, wipe off the sweat, then place the towel back in the bag and continue on. Even worse is the runner doing that same scenario while trying to maintain the running pace. That would be difficult and dangerous. This would be the same as if a runner would try to stuff a towel in their waistband and just as improbable for a runner to hold a towel in their hand throughout the duration of their entire run. This similar problem can be found in the gym on a treadmill or other piece of cardio equipment (e.g., elliptical, stationary bike, and climber, etc.). The runner doesn't have the means to hold or carry a towel while performing their work out. It may be argued that the runner can just place the towel on the treadmill/equipments arm supports or control board but then they also pose the same problem with tainting the towel with dirt and germs as previously stated. It also is awkward and possibly dangerous for the runner to constantly look away from what they are doing, to locate, reach out, and grab the towel off the equipment to towel off. This could cause the runner to misstep, stumble, trip, and ultimately fall.

Other situations where a towel is beneficial can be for persons gardening and cooking. Many times these people cannot grab and use a towel because their hands are soiled with cooking material, or contaminated raw ingredients, or are full of dirt or wearing dirty gloves and can't grab a towel. Likewise, the towel will first contact the soiled hands before the other body parts, e.g., forehead, which are less soiled but perhaps have perspiration.

SUMMARY OF THE INVENTION

The present technology therefore provides a garment or item of apparel which is specially designed to provide a hands free absorbing surface to wipe away and absorb sweat and other bodily fluids.

The most natural and ergonomic way to wipe away sweat without the use of one's hands is to use the inlet of one's arm from shoulder to forearm and to the back of the hand.

The regions of contact can consist of the shoulder, deltoid, bicep, a portion or the tricep, inner and outer forearm, and back of hand. The Towel/absorptive material sleeve can be made from a variety of absorptive materials. The primary absorptive material for this towel sleeve design is a terry cloth. The design can also utilize any other flexible absorptive materials, including sponge material, absorptive paper, microfiber cloth, woven and non-woven fabrics and sheets, reusable or disposable absorptive pads, and the like.

The design may encompass a variety of embodiments.

A first embodiment, of the design provides a single towel/absorptive material formed into a continuous tubular hollow structure open end at both ends. The structure may have a convenience pocket on the upper triceps region, which may be made from the same or a different material from the hollow structure. The pocket may have a Velcro closure or other type of fastener. This structure can be secured in a number of ways in place snuggly to the wearers' body. A couple of these fastening systems are as follows:

1. Three (or more) elastic draw strings with spring loaded locks or wheel drawstring locks can be provided, in the seam at the upper and lower opening, as well as near the elbow. The drawstrings restraint the tubular structure against slippage up or down the arm and also rotationally about the arm. The seams in which the drawstrings are located may have a rubber strips lining against the wearer's skin, to help prevent the sleeve from slipping and remaining in place on the wears' arm. The upper end of the structure is preferably at the upper bicep and lower deltoid region of the arm, the lower end of the structure is at the wrist. The spring loaded locks may have securing strings to secure them to the towel sleeve.

2. Three (or more) nylon Velcro fastening straps along with rubber strips on the inside surface of the hollow structure, located at each end of the structure and mid range, to help prevent the sleeve from slipping and holding the tubular structure in place on the wears' arm. One end of the structure is at the upper bicep and lower deltoid the other end of the structure is at the wrist.

3. Three (or more) buckles with side locks, which retain adjustable fastening straps, along with rubber strips on the inside surface of the hollow structure at each end of the structure and mid range, to help prevent the sleeve from slipping and remaining in place on the wears' arm. The locations of the adjusting side lock straps are at both ends of the tubular structure and at the mid range of the tubular structure. One end of the structure is at the upper bicep and lower deltoid the other end of the structure is at the wrist.

A second embodiment of the design provides a planar towel/absorptive material sheet which is wrapped around the wearer's arm, formed into a continuous tubular hollow structure with two open ends. The structure may have a convenience at the upper bicep end which is also made from the towel/absorptive material or another material, with a fastener which may be Velcro or other fastener type. The tubular structure may have an inner lining formed of a spandex polyester mix breathable mesh moisture wicking material, such as Nike Dri-Fit, to provide an arm warming support sleeve used to aid muscles and tendons with strains and tendinitis (or other tight snug fitting material) inner lining to secure the towel sleeve tightly snug to the wearers arm. One end of the structure is at the upper bicep and lower deltoid the other end of the structure is at the wrist. Alternately, instead of a liner formed of a different material, the liner may also be formed of a terry cloth or other absorptive material. The tubular structure in that case comprises a double layer of towel material with an elastic layer attached in between for tightness and snug fit to the wearers' arm.

A third embodiment of the design consists of a single towel/absorptive material with fasteners in fixed position along each seam to form the towel into a tubular structure with an open end at both ends of the structure. The towel material has three terry cloth elastic bands attached to the inner surface at each end of the structure and mid range to prevent the sleeve from slipping and remaining in place tightly on the wear's arm until the wearer secures the permanent fasteners. The permanent may be, for example, Velcro strips, Snap buttons, strong magnets, and buttons with elastic bands.

A fourth embodiment of the design provides an auxiliary wiping portion in the form of a folding towel glove/mitten/pouch attached to the bottom seam of the inner or outer wrist end, to provide supplemental wiping surface. This glove/mitten/pouch is stored to the inner or outer wrist either by a terry cloth elastic band, or towel pocket which the glove/mitten/pouch is tucked away into. Another auxiliary wiping portion is configured as a folding towel flap with terry cloth elastic palm strap slip attached to the bottom seem of the outer wrist end, to add extra wiping surface to the back of the wearer's hand. This flap is held to the outer wrist either by a terry cloth elastic band or towel pocket in which the flap is tucked into.

An inner lining for the sleeve may be provided as a moisture absorbing inner lining to draw the sweat/fluid from the surface of the towels' outer material to the inner layer and into the moisture absorbing inner layer, to give the towel more capacity and a rejuvenating ability to prolong the use of the towel. This lining can also include a breathable inner lining which helps to evaporate or wick the moisture from the towel like found in skiing and cold weather apparel.

The design may also incorporate a wrist support brace on the interior of the towel material with the tightening strap fasteners protruding through the terry cloth on the far side (underside) of the towel sleeve.

A further design option provides an arm/elbow support brace on the interior of the towel material with the tightening strap fasteners protruding through the terry cloth on the far side (underside) of the towel sleeve.

The terry material may be provided as flaps or an inlet portion formed of terry cloth or other absorbent material extending from the chest to abdomen.

DESCRIPTION OF THE PREFERRED EMBODIMENTS

Towel Arm Sleeve with Draw String Fasteners

Figures 1A, 1B:
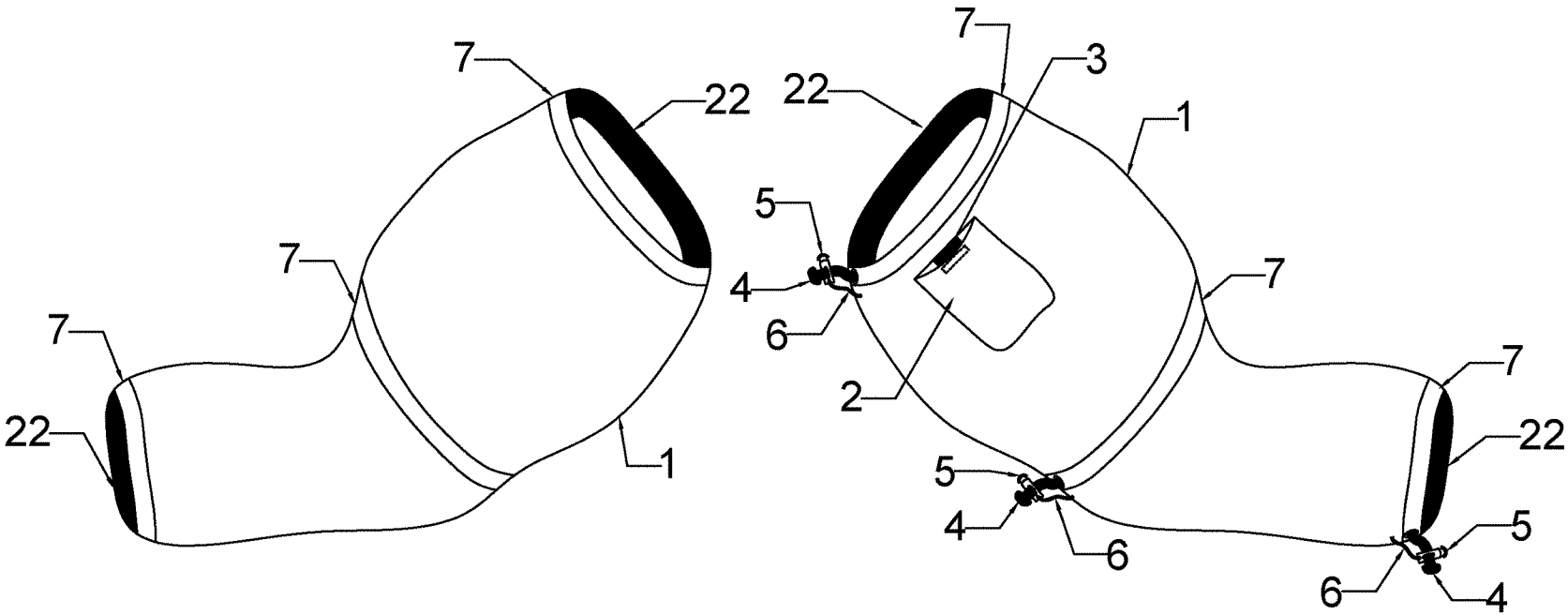
FIGS. 1A and 1B show an inner and outer view of towel sleeve, respectively, with pocket and elastic draw strings and spring loaded locks fasteners.

As shown in FIGS. 1A and 1B, a single layer of towel/absorptive material 1, such as terry cloth, formed into a continuous tubular hollow structure with openings at both ends of the structure, is provided. The structure has a pocket 2 at the upper bicep end, which may also be made from the towel/absorptive material, with a Velcro or other suitable material fastener 3. The pocket is for convenience, and may be designed to hold a music player, phone, keys, or the like. Three elastic draw strings 4 with spring loaded locks 5 are provided within guide tubes 7 to lock the draw string 4 tightly in place, to apply a pressure to rubber strips 22 on the inside surface of the hollow structure, at each end of the structure and mid range, to help prevent the sleeve from slipping and remaining in place on the wearer's arm. The locations of the draw strings are at both ends of the tubular structure and at the mid range of the tubular structure. One end of the structure is at the upper bicep and lower deltoid the other end of the structure is at the wrist. The spring loaded locks have securing strings 6 to secure them to the towel sleeve.

Towel Arm Sleeve with Adjusting Nylon Velcro Fastening Straps

Figure 2B:
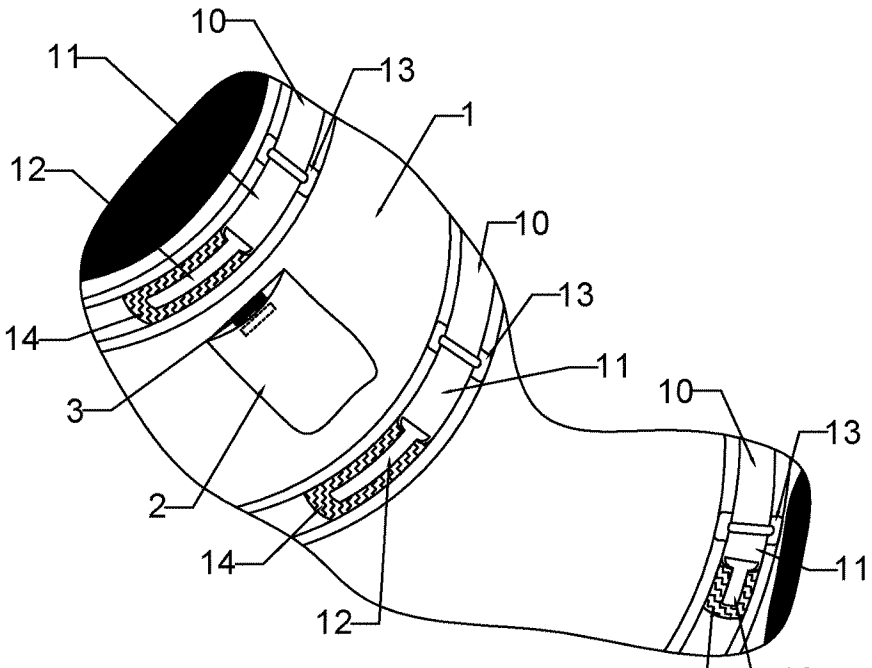
FIGS. 2A and 2B show an inner and outer view of towel sleeve, respectively, with pocket and nylon Velcro straps fasteners.
Figure 2A:
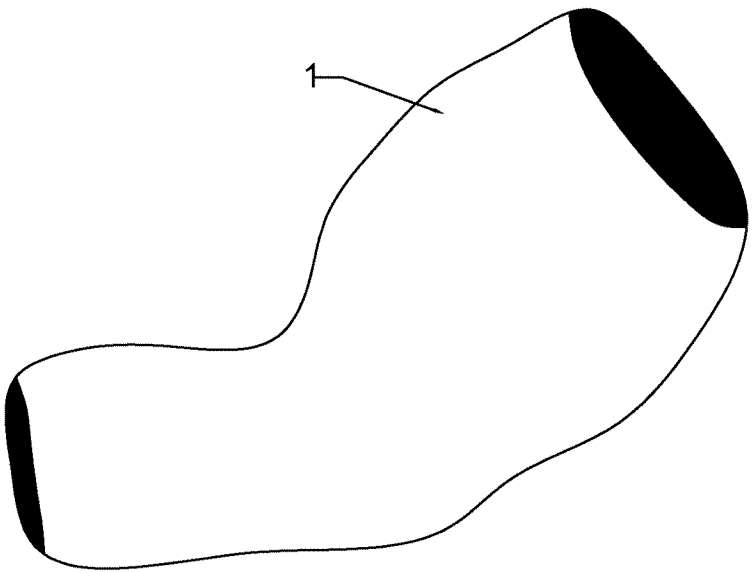

As shown in FIGS. 2A and 2B, a single layer of towel/absorptive material 1 formed into a continuous tubular hollow structure with an open end at both ends of the structure. The structure has a pocket 2 at the upper bicep end which is also made from the towel/absorptive material with a fastening closer 3 primarily Velcro but can be any form or a fastener. Three nylon fastening straps 10 along with rubber strips 22 on the inside surface of the hollow structure at each end of the structure and mid range to help prevent the sleeve from slipping and remaining in place on the wears' arm. The locations of the nylon straps 10 are at both ends of the tubular structure and at the mid range of the tubular structure. A Velcro patch 12 and anchor 14 is used to adjust the tension and size of the strap. One end of the structure is at the upper bicep and lower deltoid the other end of the structure is at the wrist. The Velcro strap may be held in position by a rectangular O-ring 13.

Towel Arm Sleeve with Adjusting Nylon Side Lock Fastening Straps

Figure 3B:
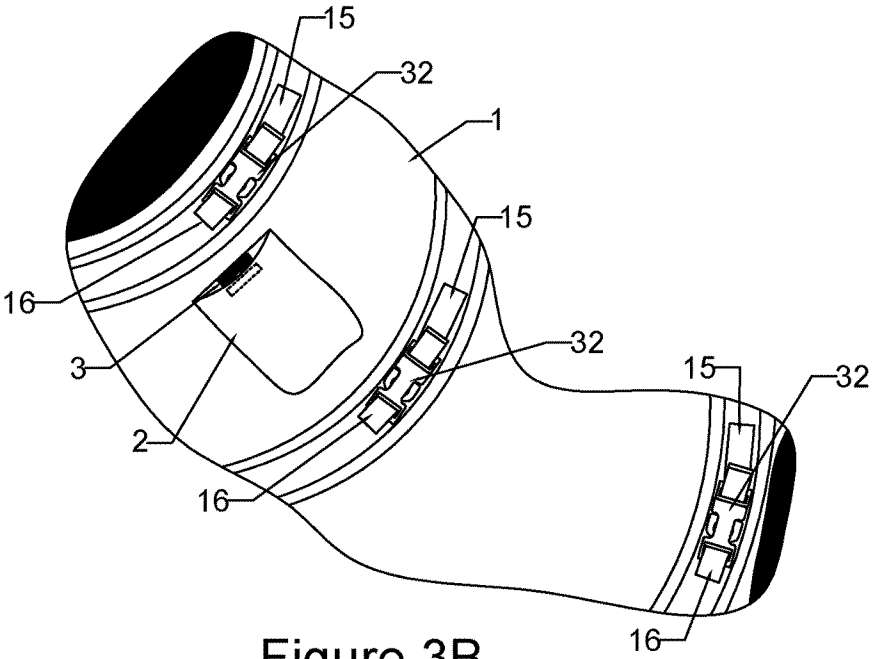
FIGS. 3A and 3B show an inner and outer view of towel sleeve, respectively, with pocket and nylon strap side locks fasteners.
Figure 3A:
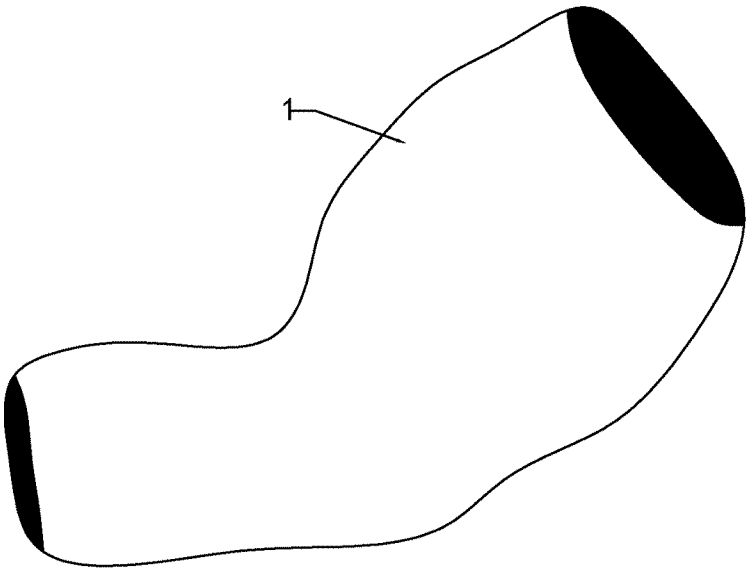

As shown in FIGS. 3A and 3B, a layer of single towel/absorptive material 1 formed into a continuous tubular hollow structure with an open end at both ends of the structure. The structure has a pocket 2 at the upper bicep end which is also made from the towel/absorptive material with a fastening closer 3 which may be made of Velcro or formed in another manner as another type of fastener. Three adjusting side lock 32 fastening straps 15, 16 along with rubber strips 22 on the inside surface of the hollow structure at each end of the structure and mid range to help prevent the sleeve from slipping and remaining in place on the wears' arm. The locations of the adjusting side lock 32 straps 15, 16 are at both ends of the tubular structure and at the mid range of the tubular structure. One end of the structure is at the upper bicep and lower deltoid the other end of the structure is at the wrist.

Towel Arm Sleeve with Spandex Polyester Mix Breathable Mesh Dri-Fit Arm Support

Figure 4B:
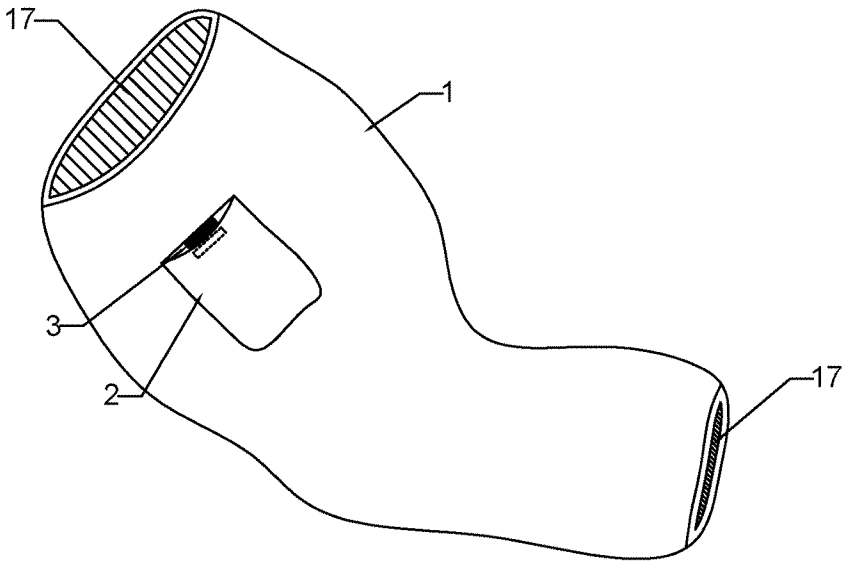
FIGS. 4A and 4B show an inner and outer view of towel sleeve, respectively, with pocket and spandex polyester mix breathable mesh dri-fit arm warming support sleeve inner lining.
Figure 4A:
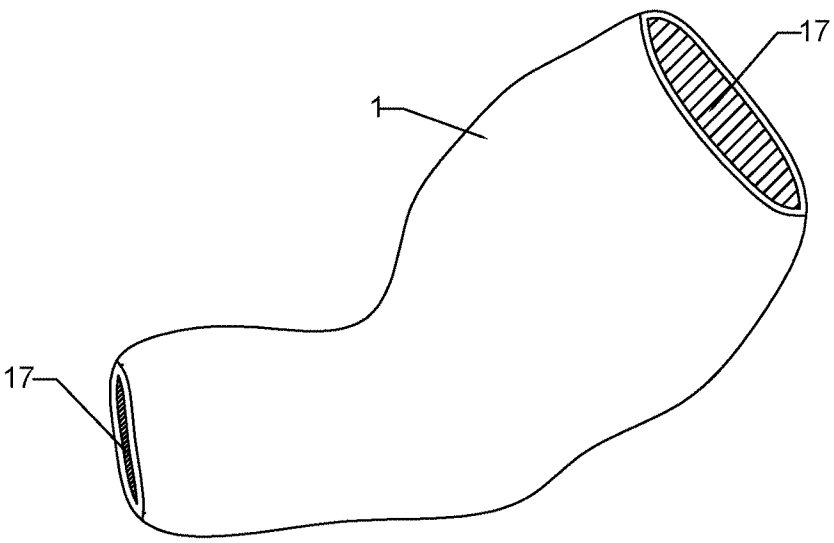

As shown in FIGS. 4A and 4B, a single layer towel/absorptive material formed into a continuous tubular hollow structure with an open end at both ends of the structure. The structure has a pocket 2 at the upper bicep end which is also made from the towel/absorptive material with a fastening closer 3. The tubular structure has a spandex polyester mix breathable mesh dri-fit arm warming support sleeve 17 used to aid muscles and tendons with strains and tendinitis (or other tight snug fitting material) inner lining to secure the towel sleeve tightly snug to the wearers arm. This forms a dual layer structure with a terry nap 1 on the outside and a dri-fit type material 17 on the inside. One end of the structure is at the upper bicep and lower deltoid the other end of the structure is at the wrist.

Towel Arm Sleeve with Spandex Polyester Mix Elastic Interlayer Sleeve Support

Figure 5B:
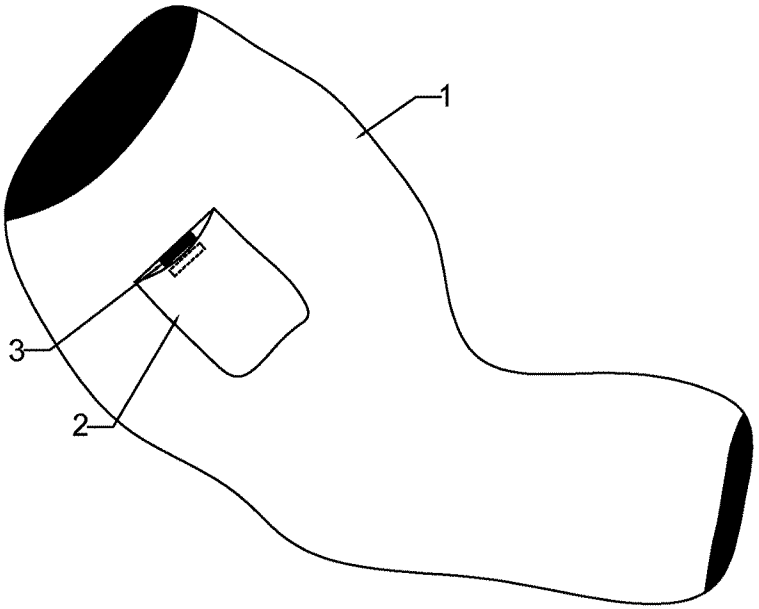
FIGS. 5A and 5B show an inner and outer view of towel sleeve, respectively, with pocket, folding towel glove and spandex polyester mix elastic interlayer sleeve support.
Figure 5A:
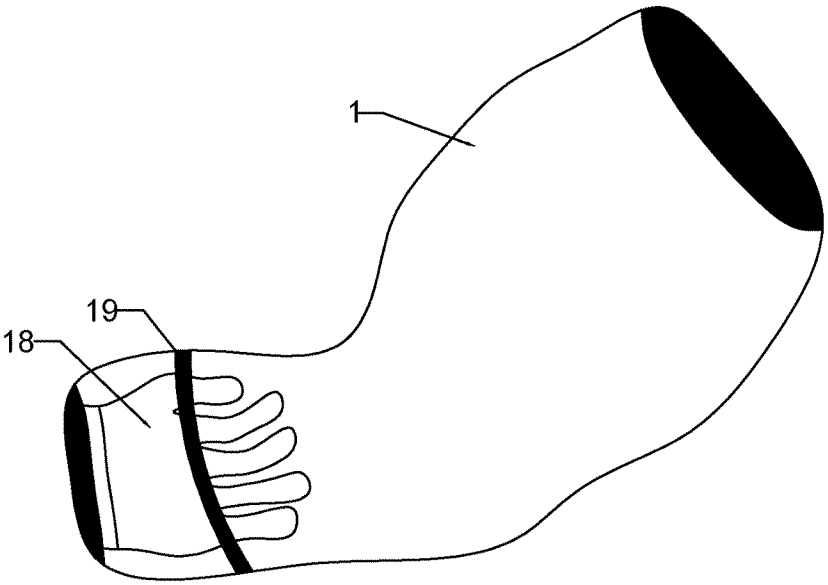
Figure 6B:
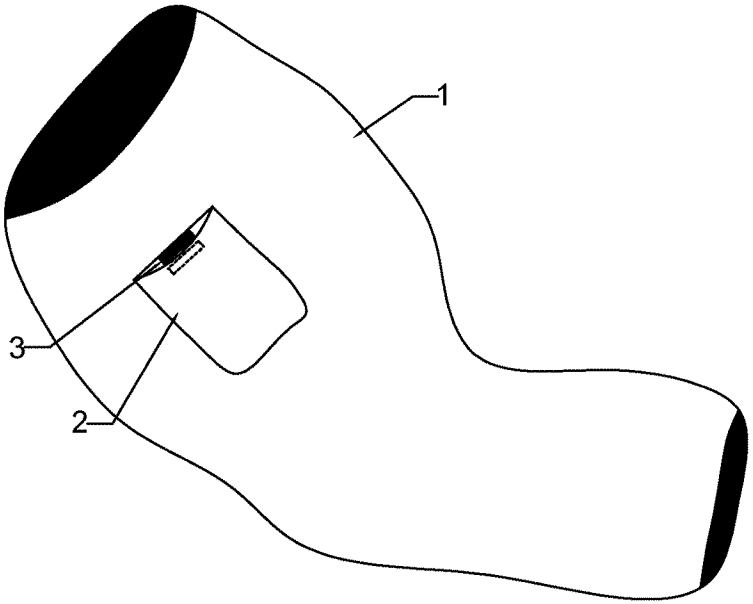
FIGS. 6A and 6B show an inner and outer view of towel sleeve, respectively, with pocket, folding towel glove in tuck away storage pocket and spandex polyester mix elastic interlayer sleeve support.
Figure 6A:
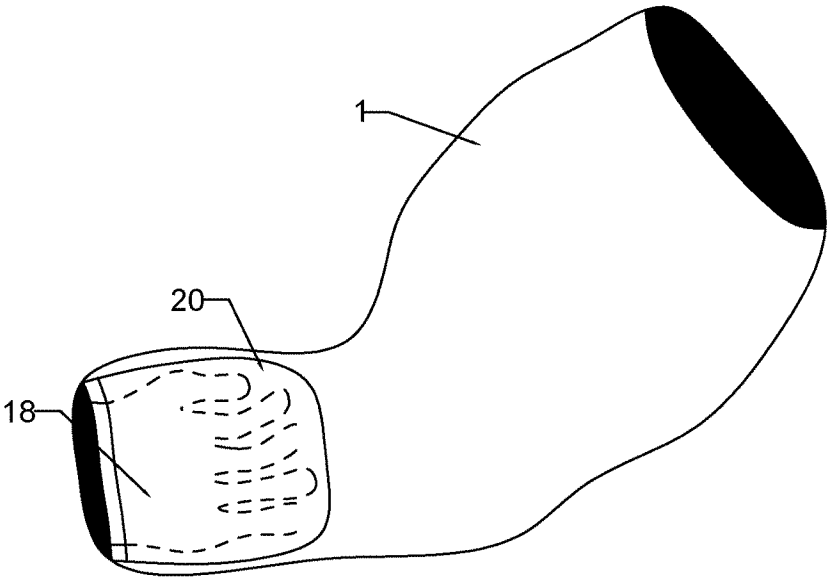
Figure 7B:
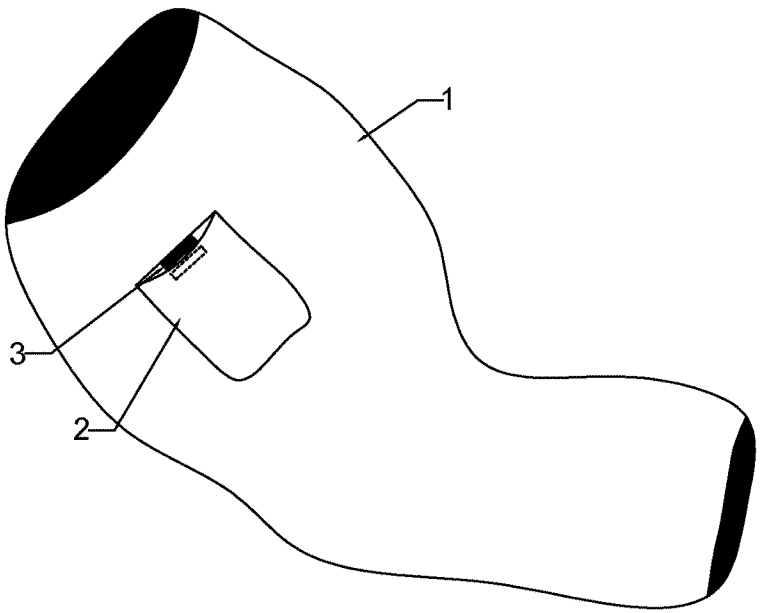
FIGS. 7A and 7B show an inner and outer view of towel sleeve, respectively, with pocket, folding towel mitten and spandex polyester mix elastic interlayer sleeve support.
Figure 7A:
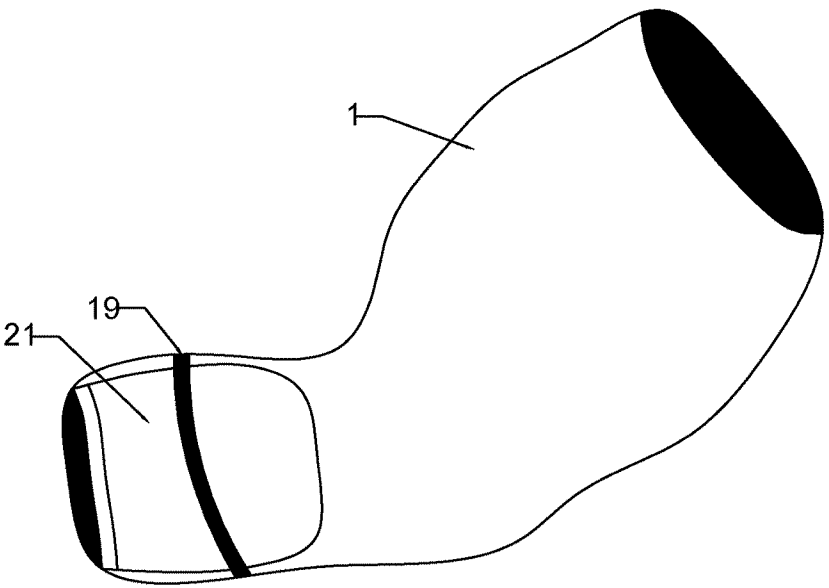
Figure 8B:
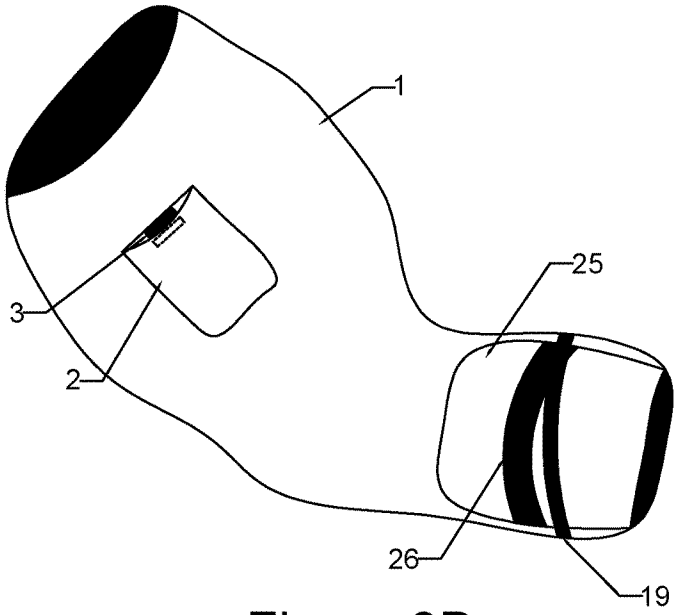
FIGS. 8A and 8B show an inner and outer view of towel sleeve respectively, with pocket, folding towel back hand towel flap with elastic palm strap and spandex polyester mix elastic interlayer sleeve support.
Figure 8A:
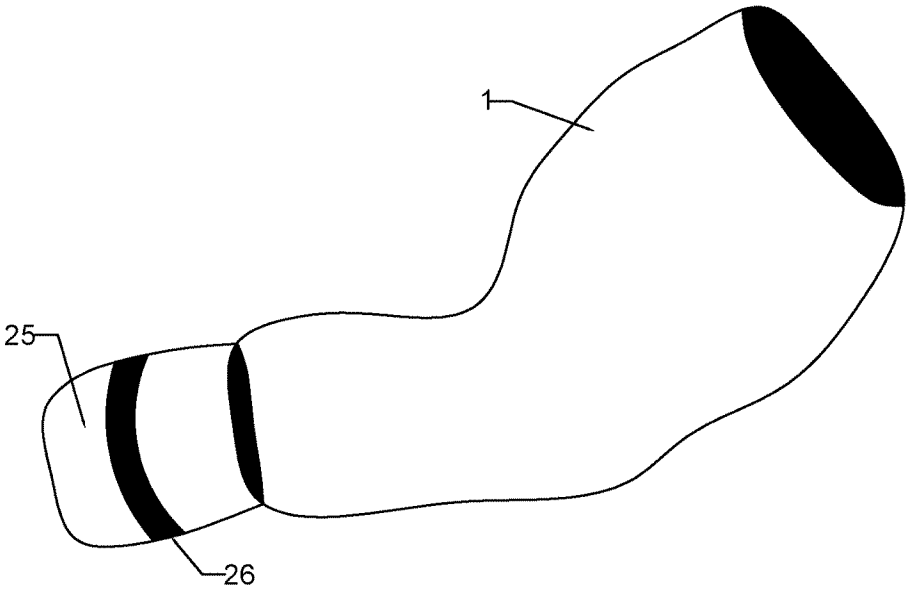
Figure 9B:
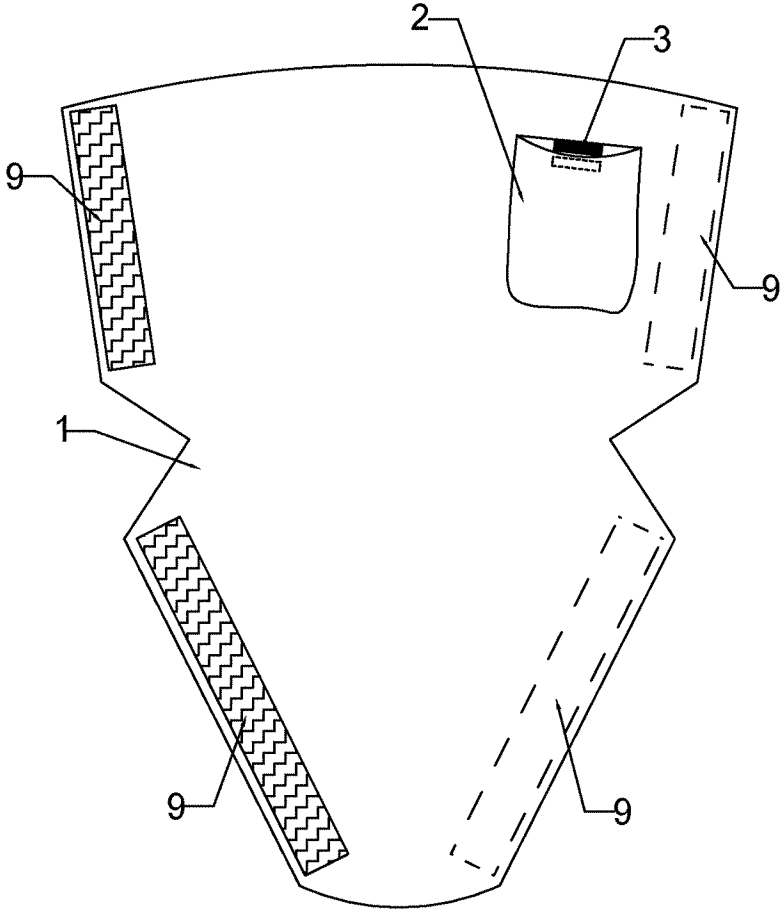
FIGS. 9A and 9B show shows an inner and outer view of Velcro seam fastening towel sleeve, respectively, with pocket and interior elastic arm support bands.
Figure 9A:
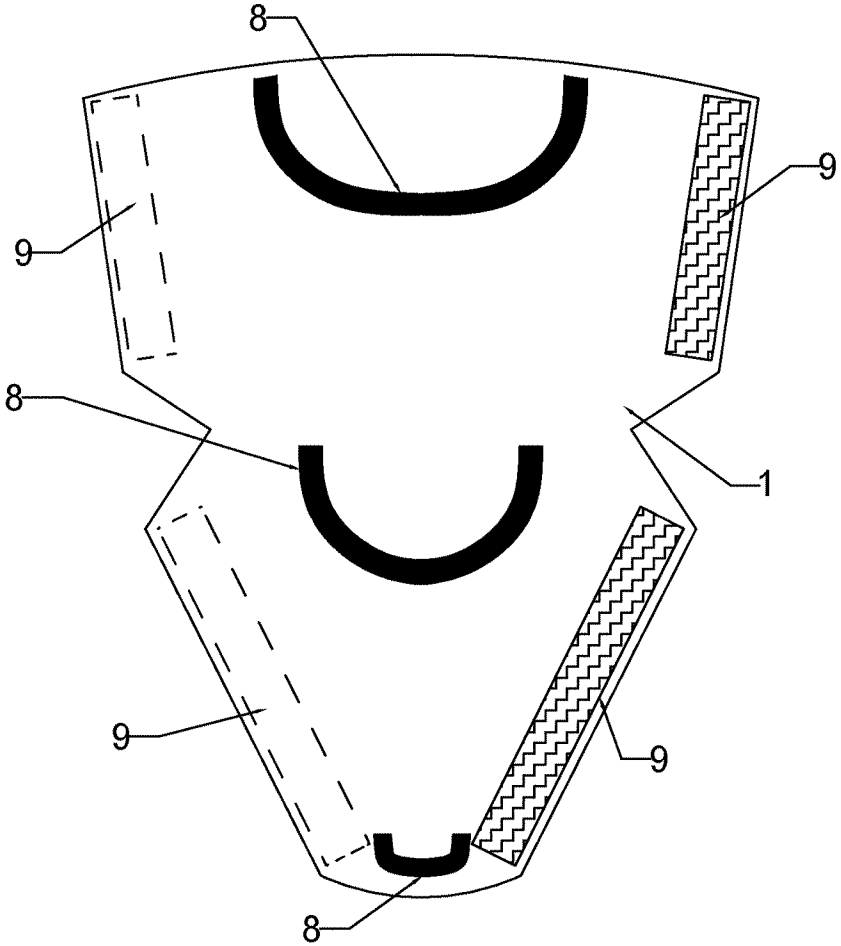
Figure 10B:
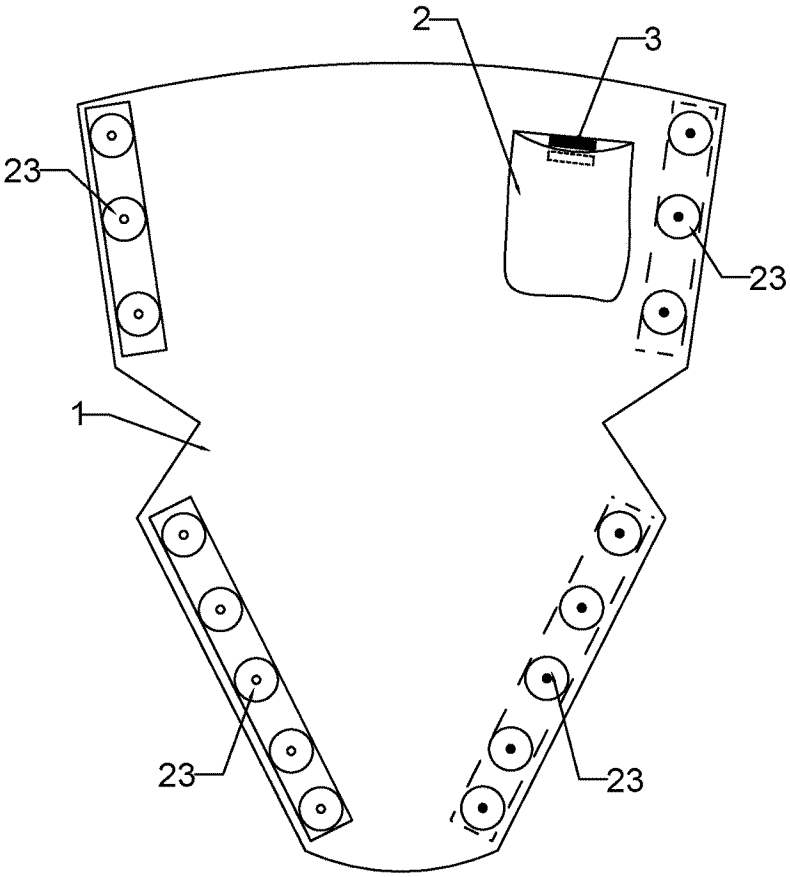
FIGS. 10A and 10B show an inner and outer view of snap button seam fastening towel sleeve, respectively, with pocket and interior elastic arm support bands.
Figure 10A:
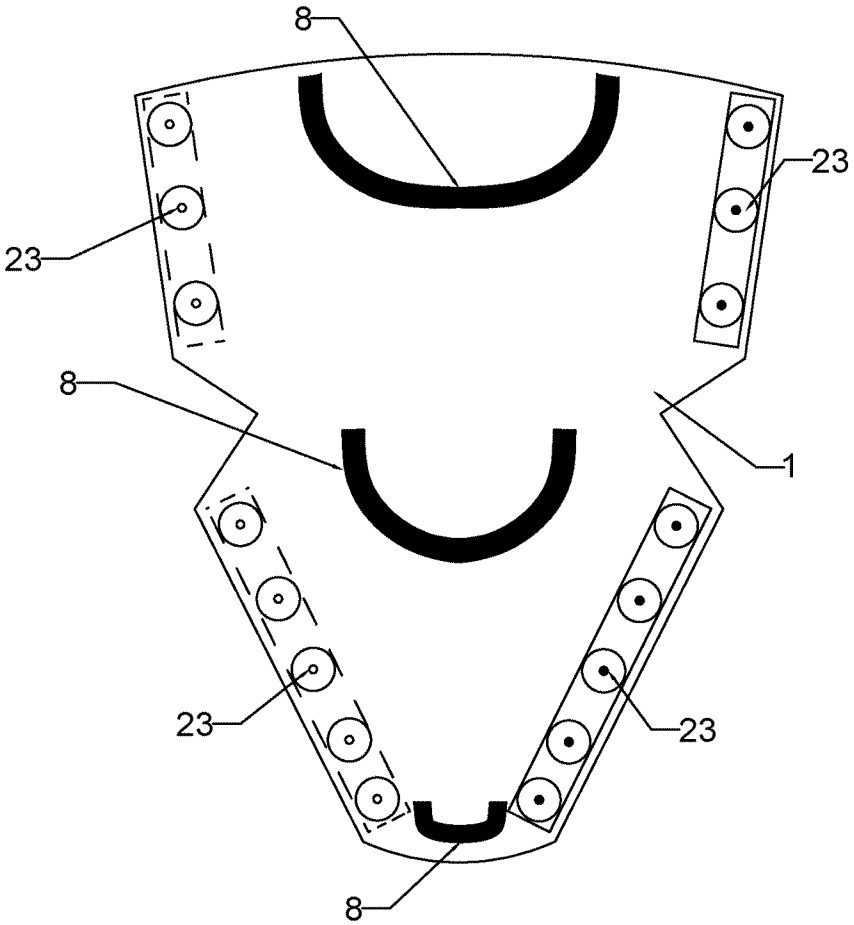
Figure 11B:
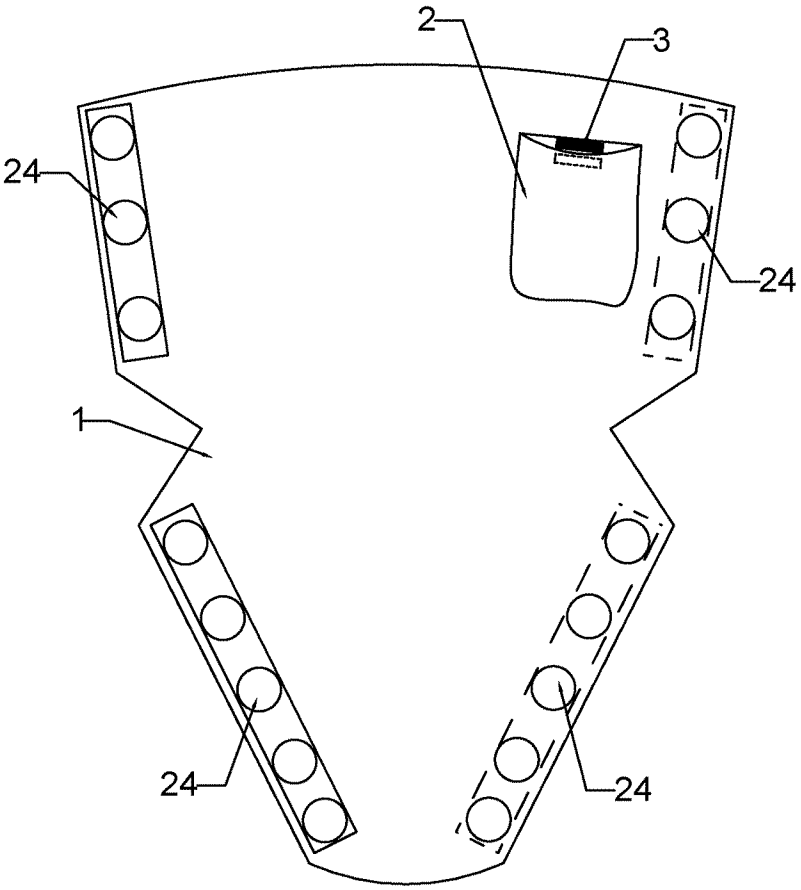
FIGS. 11A and 11B show an inner and outer view of magnetic seam fastening towel sleeve, respectively, with pocket and interior elastic arm support bands.
Figure 11A:
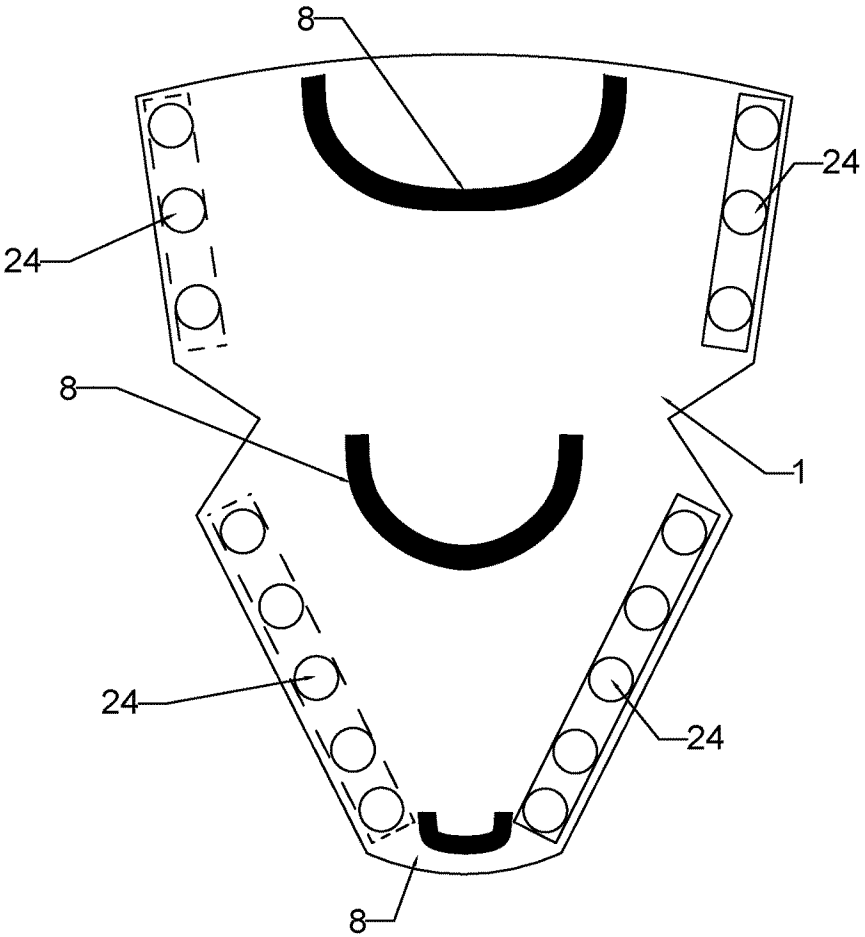

As shown in FIGS. 5A and 5B, a layer single towel/absorptive material 1 formed into a continuous tubular hollow structure with an open end at both ends of the structure. The structure has a pocket 2 at the upper bicep end which is also made from the towel/absorptive material with a fastening closer 3. The tubular structure is comprised of a double layer of towel material with an elastic layer attached in between for tightness and snug fit to the wearer's arm, so that the towel material is held against the wearer's arm on the inner surface as well on the outer surface. The sleeve also consists of a folding towel glove/mitten 18 attached to the bottom seam of the inner or outer wrist end, to add extra wiping surface. This glove/mitten 18 is held to the inner or outer wrist either by a terry nap exterior elastic band 19 or towel pocket 20 shown in FIGS. 6A and 6B which the glove/mitten 18 is tucked away into. As shown in FIGS. 8A and 8B, the sleeve may also consist of a folding towel back hand flap 25 with towel wrapped elastic palm strap slip 26 attached to the bottom seam of the outer wrist end, to add extra wiping surface to the back of the wearers' hand. This flap 25 is stored at the outer wrist either by a towel wrapped elastic band 19 or towel pocket (not shown) in which the flap may be tucked away.

Seam Fastening Towel Sleeve

As shown in FIGS. 9A, 9B, 10A, 10B, 11A, and 11B, a single towel/absorptive material 1 with fasteners 9, 23, 24 along each seam to form the towel into a tubular structure, with open ends at both ends of the structure. The towel material 1 has three towel wrapped elastic bands 8 attached to the inner surface at each end of the structure and mid range, to prevent the sleeve from slipping and remaining in place tightly on the wears' arm until the wearer secures the permanent fasteners 9. The permanent fasteners 9 are but not limited to the following types: velcro strips 9, snap buttons 23, strong magnets 24, and buttons with elastic bands (not shown). The diameter of the sleeve may be adjusted by lacing (such as on a shoe or girdle), an elastic region on the back of the arm, or the like.

Towel Sleeve with Wrist Support Brace

A single towel/absorptive material 1 may be formed into a continuous tubular hollow structure with an open end at both ends of the structure. The structure may have a pocket 2 at the upper bicep end which is also made from the towel/absorptive material with a fastening closer 3 such as Velcro. Three elastic draw strings 4 with spring loaded locks 5 to lock the draw string tightly in place along with rubber strips 22 on the inside surface of the hollow structure at each end of the structure and mid range to help prevent the sleeve from slipping and remaining in place on the wear's arm. The locations of the draw strings 4 are at both ends of the tubular structure and at the mid range of the tubular structure. One end of the structure is at the upper bicep and lower deltoid the other end of the structure is at the wrist. The spring loaded locks 5 have securing strings 6 to secure them to the towel sleeve. A wrist support brace (not shown, but similar to the nylon anchor strap 10 of FIGS. 2A and 2B) is attached at the wrist end of the tubular towel structure on the inner surface/lining of the structure. The wrist support braces' adjustment region, having a Velcro fastener 12 and Velcro anchor 14 protrudes through the tubular towel structure on the underside of the wrist of the structure for tightening the support brace.

Towel Sleeve with Arm/Elbow Support Brace

A single layer of towel/absorptive material 1 formed into a continuous tubular hollow structure with an open end at both ends of the structure.

The structure may have a pocket at the upper bicep end which is also made from the towel/absorptive material with a fastening closure, which can be Velcro or another form of fastener. The pocket may be separable from the sleeve, for example held in place by strong magnets, e.g., samarium cobalt magnets or other rare earth types. These permit the pocket to be modular, for different devices, to bear logos, and the like.

Three elastic draw strings 4 with spring loaded locks 5 to lock the draw string tightly in place along with rubber strips 22 on the inside surface of the hollow structure at each end of the structure and mid range to help prevent the sleeve from slipping and remaining in place on the wear's arm. The locations of the draw strings 4 are at both ends of the tubular structure and at the mid range of the tubular structure. One end of the structure is at the upper bicep and lower deltoid the other end of the structure is at the wrist. The spring loaded locks 5 have securing strings 6 to secure them to the towel sleeve. An arm/elbow support brace (not shown) is attached on the inner surface/lining of the tubular towel structure. The arm/elbow support braces' adjusting nylon Velcro strap protrudes through the tubular towel structure on the underside of the wrist, elbow, and tricep/bicep of the structure for tightening the support brace.

Towel Flap Shirt

Figure 12:
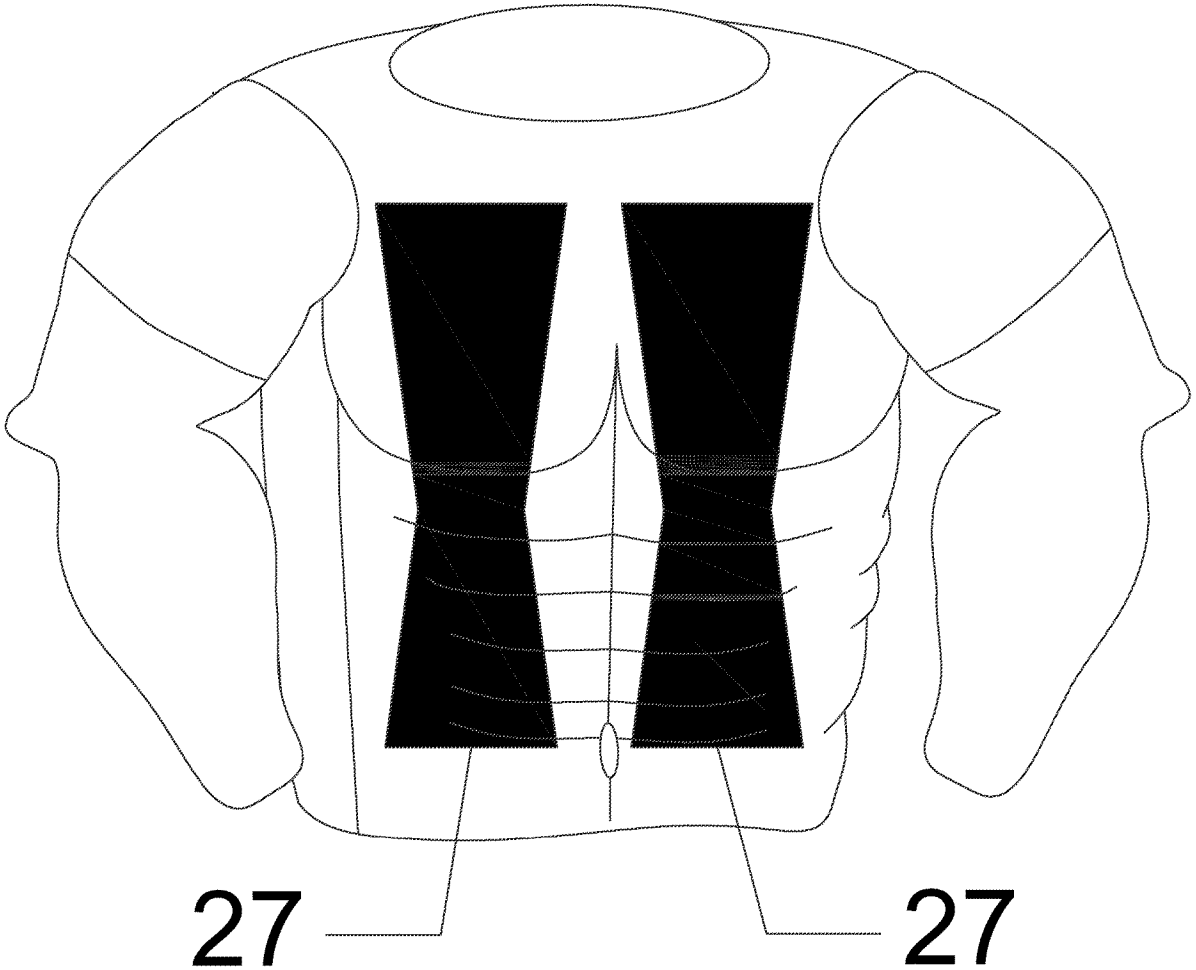
FIG. 12 shows a front view of towel flap T-shirt with terminal underside Velcro fasteners.

As shown in FIG. 12, a shirt (long or short sleeve) comprises two or more Towel/absorptive material flaps 27 attached to the shirt. The towel flaps 27 are attached to the shirt at the upper end of the towel flap 27 above the wearers' chest. The other unfixed lower end of the towel flap 27 is secured to the torso (mid or lower) by a fastener. The fastener may be, for example, velcro strips, snap buttons, magnets, or buttons with elastic bands.

Towel Torso Shirt

Figure 13:
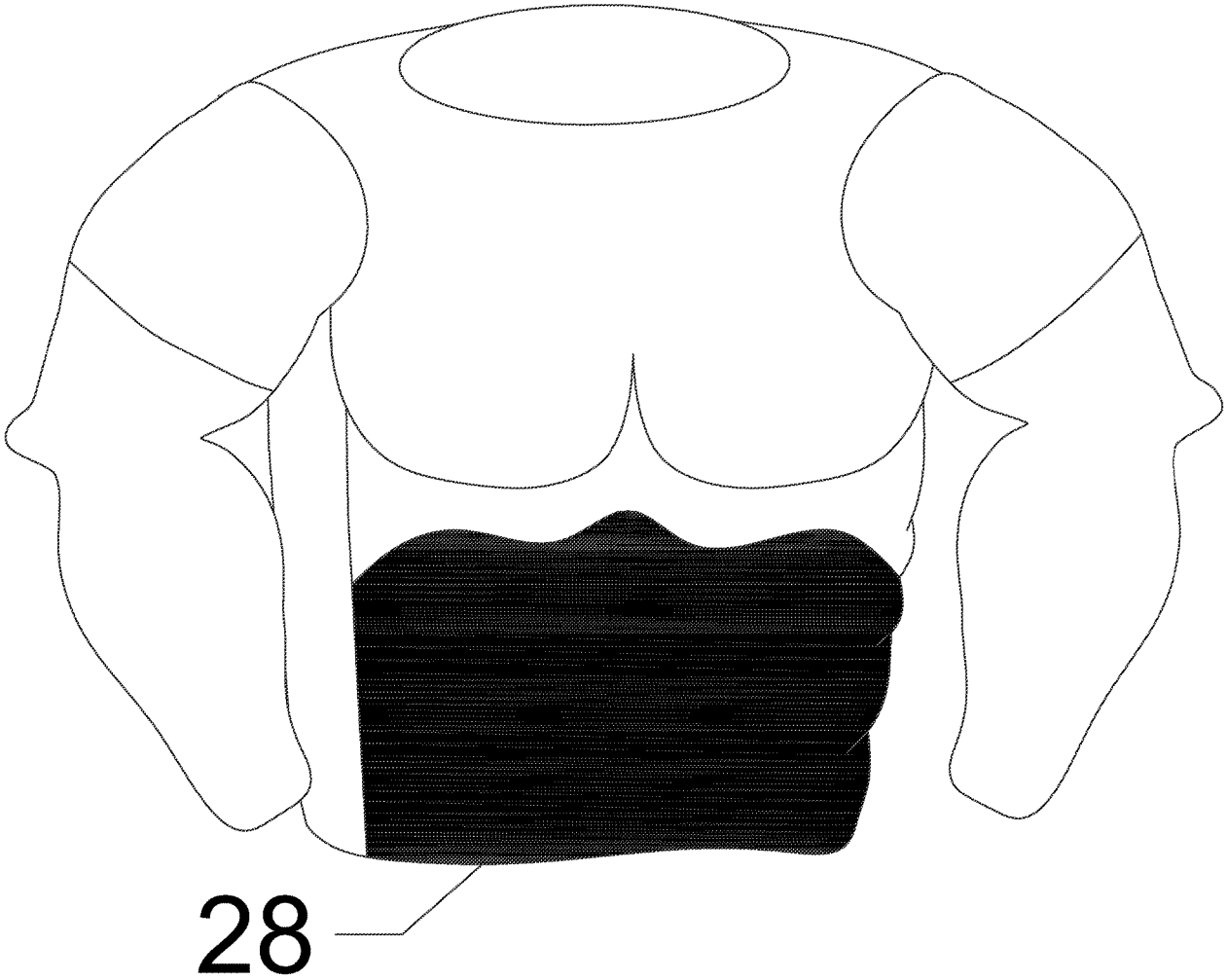
FIG. 13 shows a front view of towel torso T-shirt.
Figure 14:
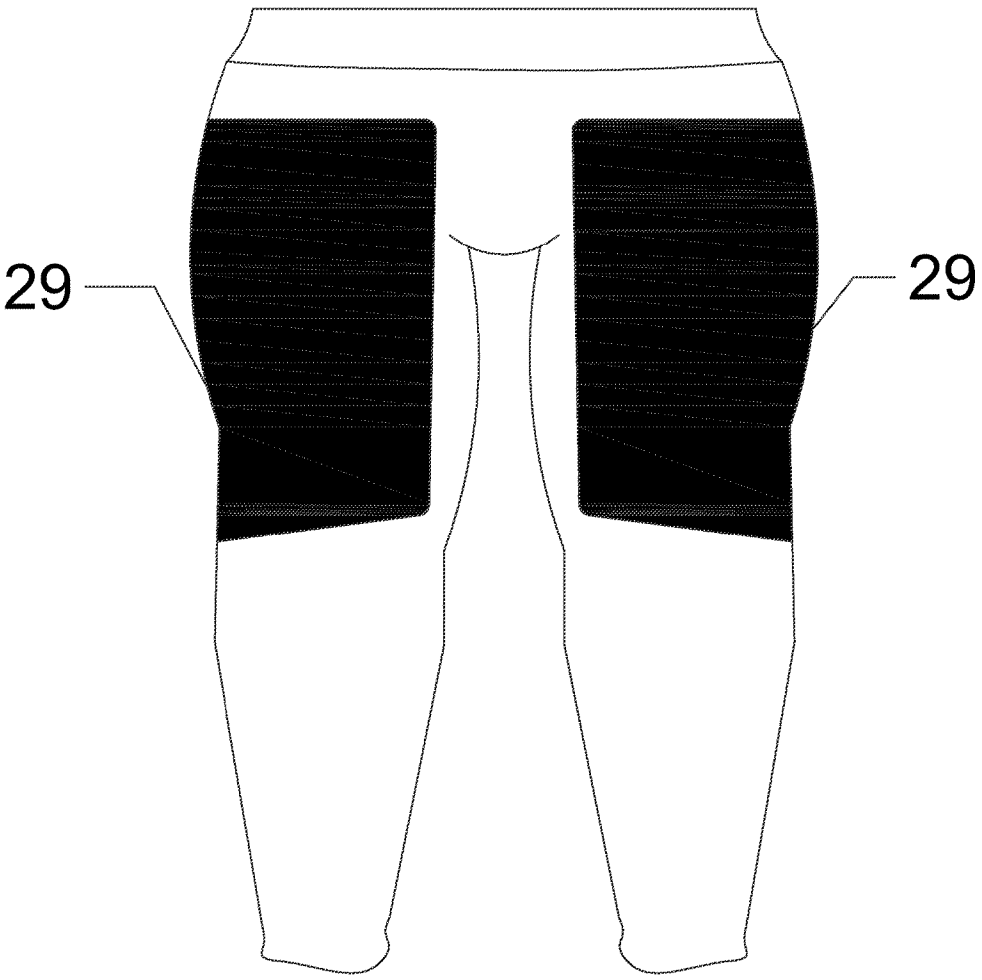
FIG. 14 shows a front view of towel thigh and hamstring pants.
Figure 15:
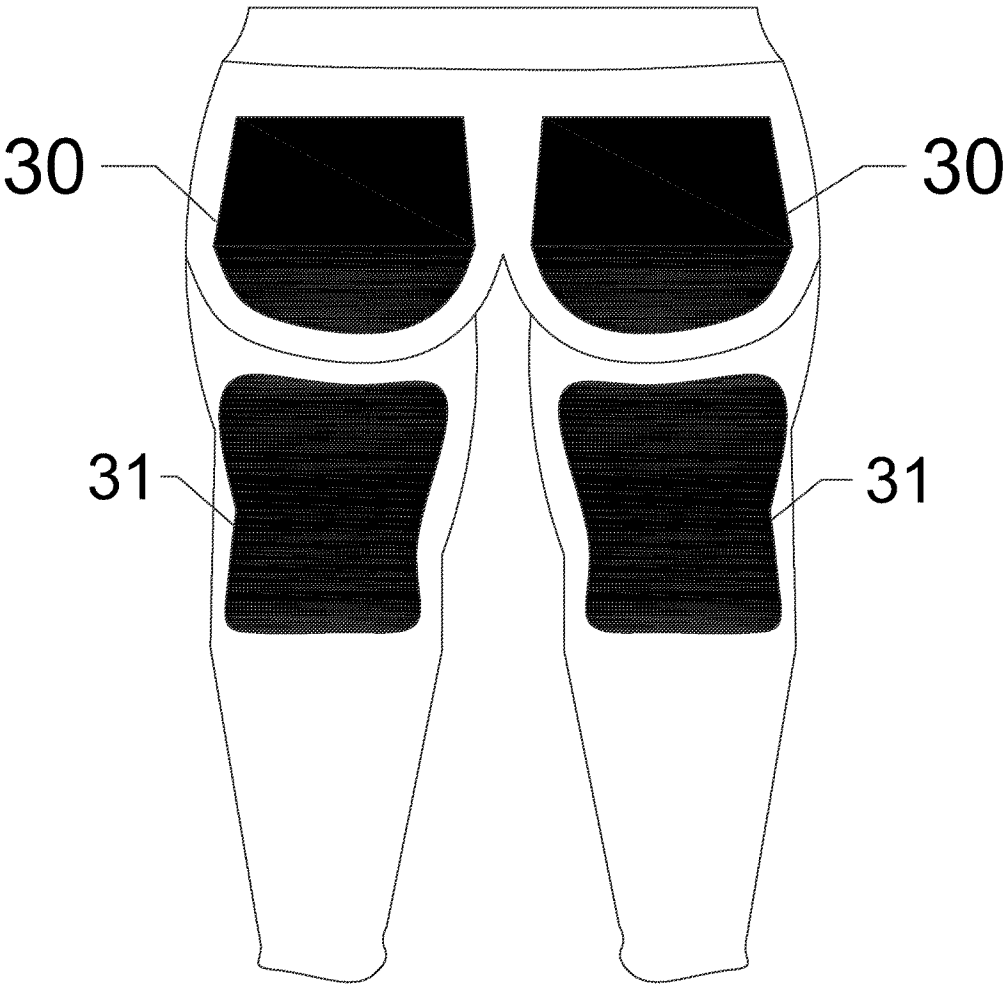
FIG. 15 shows a rear view of towel thigh and hamstring pants.
Figure 16:
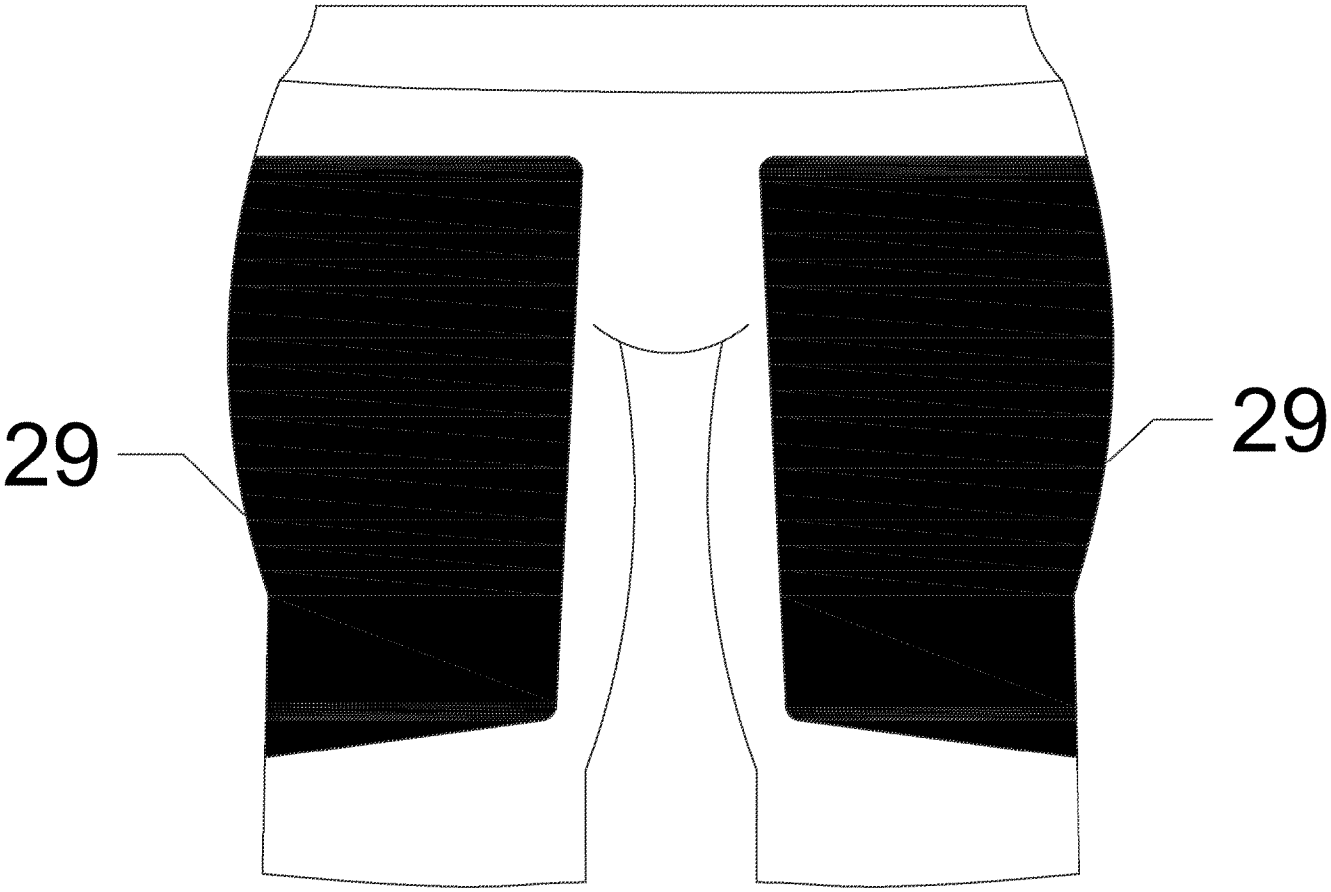
FIG. 16 shows a front view of towel thigh and hamstring shorts.
Figure 17:
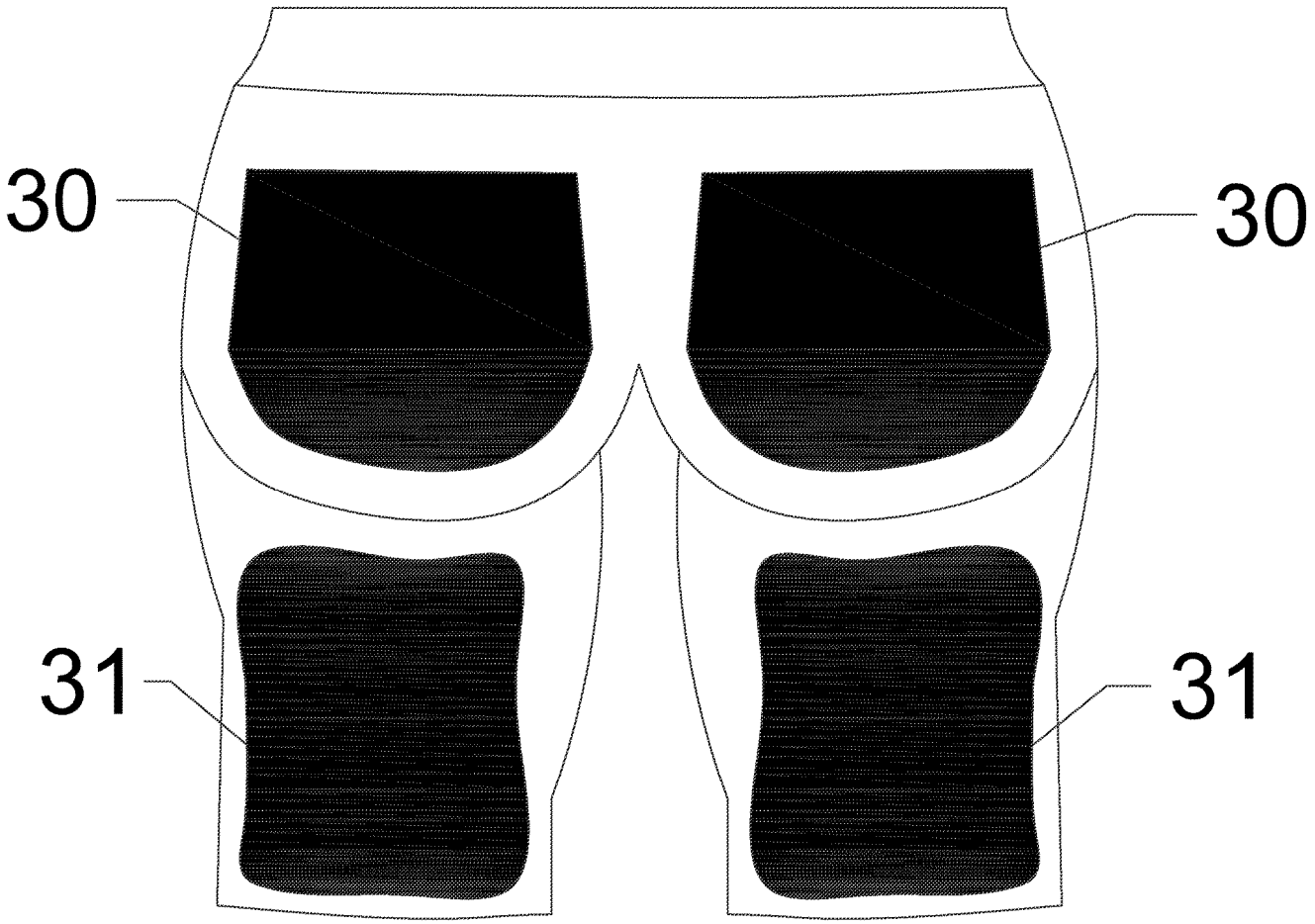
FIG. 17 shows a rear view of towel thigh and hamstring shorts.

As shown in FIG. 13, a shirt (long or short sleeve) comprises a towel/absorptive material area 28 attached or infused to the torso section of the shirt.

Towel Thigh and Hamstring Pants and Shorts:

As shown in FIGS. 14, 15, 16 and 17, a pair of pants (FIGS. 14 and 15) or shorts (FIGS. 16 and 17) which comprise a towel/absorptive material area attached or infused to the thigh 29, buttocks 30, and hamstring 31 regions of the garment are provided.

Towel Skull Cap and Scarf

Figure 18:
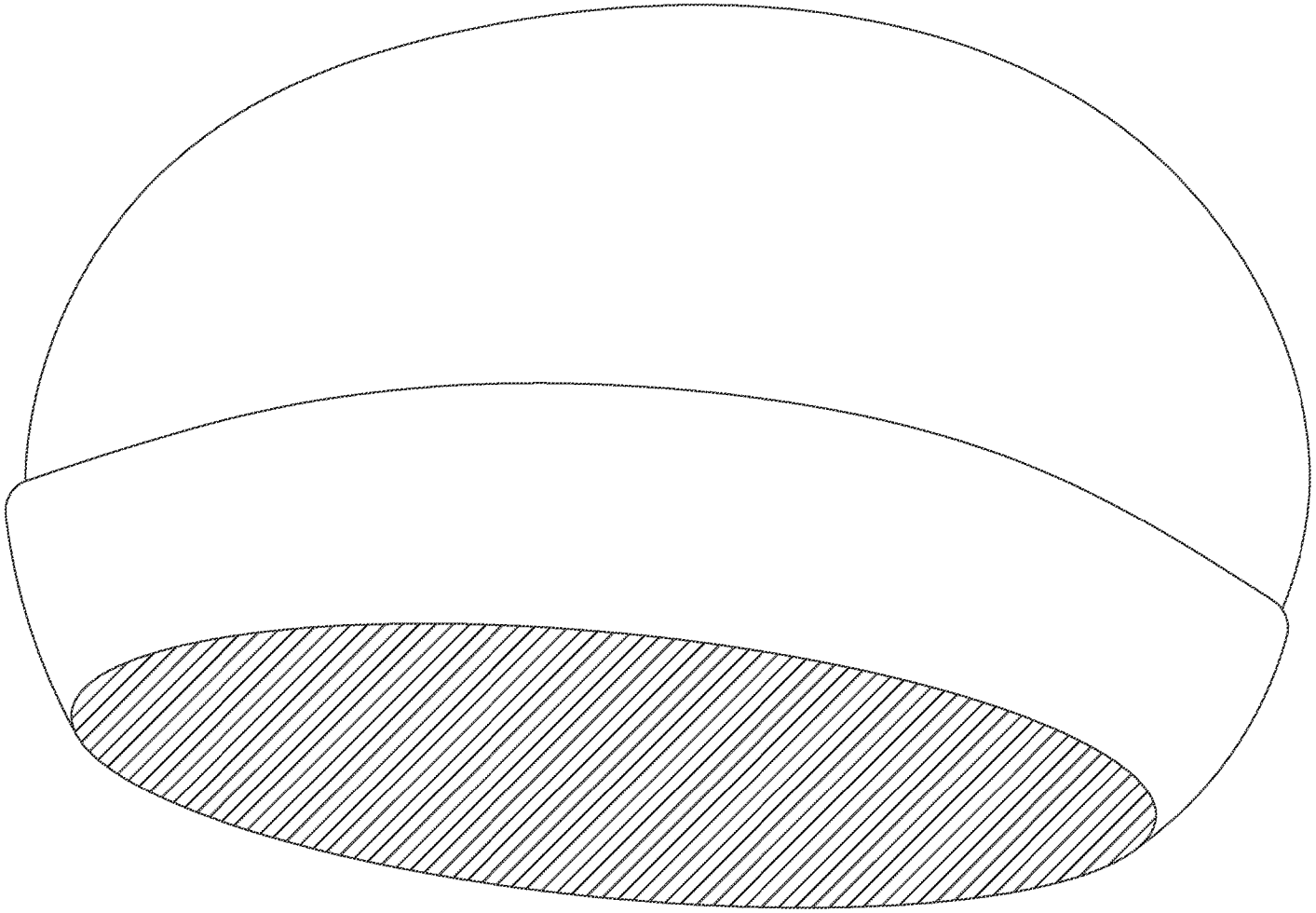
FIG. 18 shows a skull cap with fold down cuff made from towel/absorptive material.

As shown in FIG. 18, a skull cap (beanie) which is made of towel/absorptive material is provided. Alternately, an inner liner of the skull cap may be formed of a towel/absorptive material.

What is claimed is:

1. A sleeve having a tubular structure, comprising:

a planar sheet having an openable seam along its length, the planar sheet having an exterior moisture absorptive surface, and the planar sheet is configured to fit around a wearer's arm, from the wearer's shoulder to at least the wearer's forearm, the openable seam having a fastener to selectively close the planar sheet to define the tubular structure, the tubular structure having a cutout disposed along the length of the tubular structure; and a set of at least three selectively tensionable elastic loops through which the arm of the wearer is insertable, the at least three selectively tensionable elastic loops each having an adjustable diameter configured to selectively and independently control a movement of the tubular structure with respect to at least a portion of the wearer's upper arm area and a portion of the wearer's lower arm area, the at least three selectively tensionable elastic loops each having a non-slip surface disposed on an interior surface of the tubular structure which is adapted to press against skin of the wearer's arm and maintain the tubular structure in a position on a wearer without slippage, wherein one of the at least three selectively tensionable elastic loops is located at approximately the same distance as the cutout along the length of the tubular structure, wherein the tubular structure is further configured to permit free flexion of the elbow of the wearer.

2. The sleeve according to claim 1, wherein the absorptive surface comprises terry cloth.

3. The sleeve according to claim 1, wherein the adjustable diameter is controlled by a respective drawstring associated with each of the at least three elastic loops.

4. The sleeve according to claim 1, wherein the adjustable diameter is controlled by a tensionable strap associated with each of the at least three elastic loops.

5. The sleeve according to claim 1, wherein the adjustable diameter is controlled by an adjustable tension buckle associated with each of the at least three elastic loops.

6. The sleeve according to claim 1, wherein the openable seam comprises a closure.

7. The sleeve according to claim 1, wherein the openable seam comprises a snap closure.

8. The sleeve according to claim 1, wherein the openable seam comprises a magnetic closure.

9. A sleeve comprising:

a planar sheet having an openable seam along its length, the openable seam having a fastener to selectively close the planar sheet to define a tubular structure having a cloth exterior moisture absorptive surface, and the planar sheet is configured to fit around a wearer's arm, from a wearer's shoulder to at least a wearer's forearm, and the tubular structure having a cutout disposed along its length at an area corresponding to a wearer's elbow area, when worn by a wearer; and a set of at least three independently tensionable loops attached to an interior surface of the tubular structure, through which the wearer's arm is insertable, and when worn, the at least three independently tensionable loops being respectively located at an upper arm area, the elbow area, and a lower arm area of the wearer, one of the at least three selectively tensionable elastic loops being located at approximately the same distance as the cutout along the length of the tubular structure, and wherein the at least three independently tensionable loops are configured to adjust a diameter of the tubular structure and to selectively control a pressure of an interior non-slip surface of the set of at least three independently tensionable loops, to selectively control a slippage of the tubular structure and to prevent movement of the tubular structure on the wearer's skin in at least the upper arm area and the lower arm area, while permitting free flexion of the elbow of the wearer when the tubular structure is worn and disposed at the elbow area of the wearer.

10. The sleeve according to claim 9, wherein the absorptive surface comprises terry cloth.

11. The sleeve according to claim 9, wherein the adjustable diameter is controlled by a respective drawstring associated with each of the at least three elastic loops.

12. The sleeve according to claim 9, wherein the adjustable diameter is controlled by a tensionable strap associated with each of the at least three elastic loops.

13. The sleeve according to claim 9, wherein the adjustable diameter is controlled by an adjustable tension buckle associated with each of the at least three elastic loops.

14. The sleeve according to claim 9, wherein the openable seam comprises a closure.

15. The sleeve according to claim 9, wherein the openable seam comprises a snap closure.

16. The sleeve according to claim 9, wherein the openable seam comprises a magnetic closure.

* * * * *